US011624197B1

(12) United States Patent
Mc Gill

(10) Patent No.: US 11,624,197 B1
(45) Date of Patent: Apr. 11, 2023

(54) POOL SAFETY NET SYSTEM

(71) Applicant: Dennis Mc Gill, Washington, DC (US)

(72) Inventor: Dennis Mc Gill, Washington, DC (US)

( * ) Notice: Subject to any disclaimer, the term of this patent is extended or adjusted under 35 U.S.C. 154(b) by 115 days.

(21) Appl. No.: 17/176,316

(22) Filed: Feb. 16, 2021

(51) Int. Cl.
*E04H 4/06* (2006.01)

(52) U.S. Cl.
CPC ..... *E04H 4/065* (2013.01)

(58) Field of Classification Search
CPC ..... E04H 4/065
See application file for complete search history.

(56) References Cited

U.S. PATENT DOCUMENTS

| | | | | |
|---|---|---|---|---|
| 2,812,520 | A * | 11/1957 | Pinckard | E04H 4/065 49/33 |
| 3,086,219 | A * | 4/1963 | Stafford | E04H 4/065 4/504 |
| 3,184,763 | A * | 5/1965 | Kennedy | E04H 4/065 4/501 |
| 3,435,465 | A | 4/1969 | Formel | |
| 5,271,483 | A | 12/1993 | Hong | |
| 5,542,502 | A * | 8/1996 | Scriven | E04H 4/065 4/495 |
| 5,832,547 | A * | 11/1998 | Burroughs | E04H 4/065 4/504 |
| 6,493,885 | B2 | 12/2002 | Perrier | |
| 9,157,250 | B2 | 10/2015 | Alammari | |
| D771,334 | S | 11/2016 | Cockman | |
| 10,072,432 | B2 | 9/2018 | Weijers | |
| 2017/0167151 | A1* | 6/2017 | Segal | B63C 9/18 |

FOREIGN PATENT DOCUMENTS

| | | |
|---|---|---|
| WO | 2014069999 | 5/2014 |

* cited by examiner

*Primary Examiner* — J C Jacyna

(57) ABSTRACT

The pool safety net system incorporates an adjustable flooring in a pool structure. The adjustable flooring installs in the pool structure. The adjustable flooring forms a horizontal surface that supports objects that sink into the pool structure. The adjustable flooring is adjustable such that the depth that an object sinks into the pool structure is adjustable. The pool safety net system further comprises a control circuit. The control circuit controls the adjustment of the adjustable flooring. The control circuit is remotely controlled.

15 Claims, 5 Drawing Sheets

POOL SAFETY NET SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of fixed constructions including baths and pools, more specifically, a swimming pool with a floor adjustable in height. (E04H4/065)

SUMMARY OF INVENTION

The pool safety net system comprises a pool structure and an adjustable flooring. The adjustable flooring installs in the pool structure. The adjustable flooring forms a horizontal surface that supports objects that sink into the pool structure. The adjustable flooring is adjustable such that the depth that an object sinks into the pool structure is adjustable. The pool safety net system further comprises a control circuit. The control circuit controls the adjustment of the adjustable flooring. The control circuit is remotely controlled.

These together with additional objects, features and advantages of the pool safety net system will be readily apparent to those of ordinary skill in the art upon reading the following detailed description of the presently preferred, but nonetheless illustrative, embodiments when taken in conjunction with the accompanying drawings.

In this respect, before explaining the current embodiments of the pool safety net system in detail, it is to be understood that the pool safety net system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the pool safety net system.

It is therefore important that the claims be regarded as including such equivalent construction insofar as they do not depart from the spirit and scope of the pool safety net system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
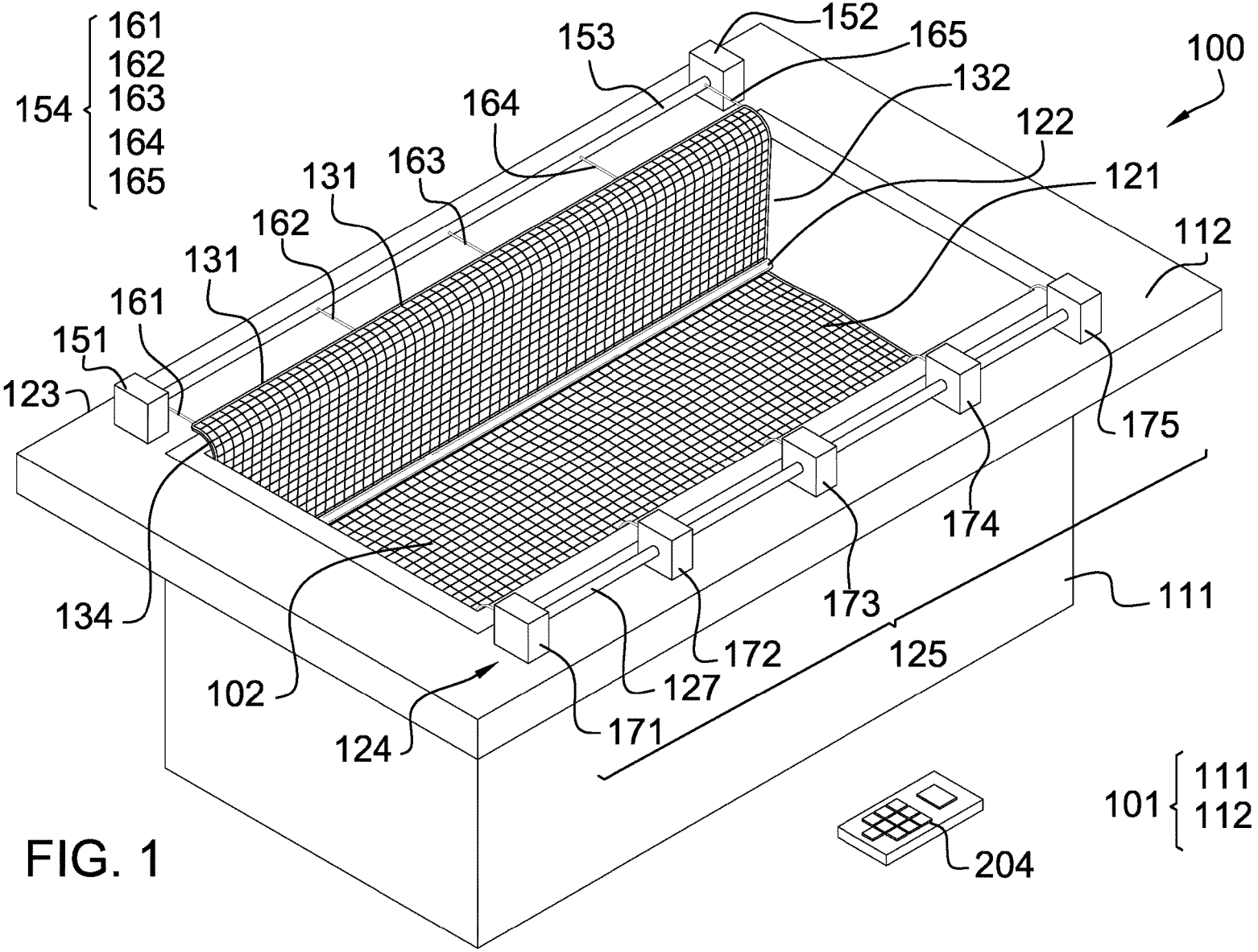
FIG. 1 is a perspective view of an embodiment of the disclosure.
Figure 2:
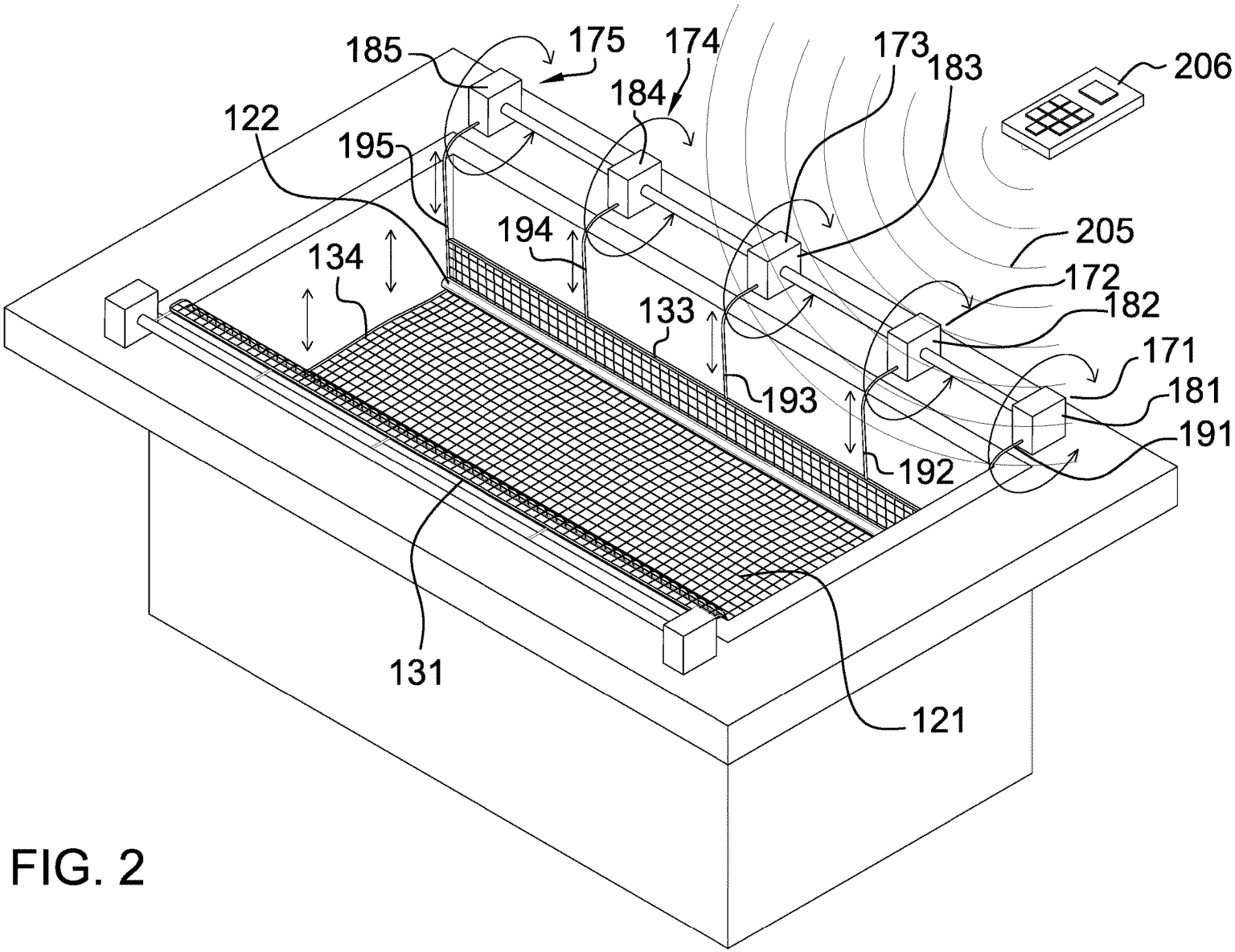
FIG. 2 is a reverse perspective view of an embodiment of the disclosure.
Figure 3:
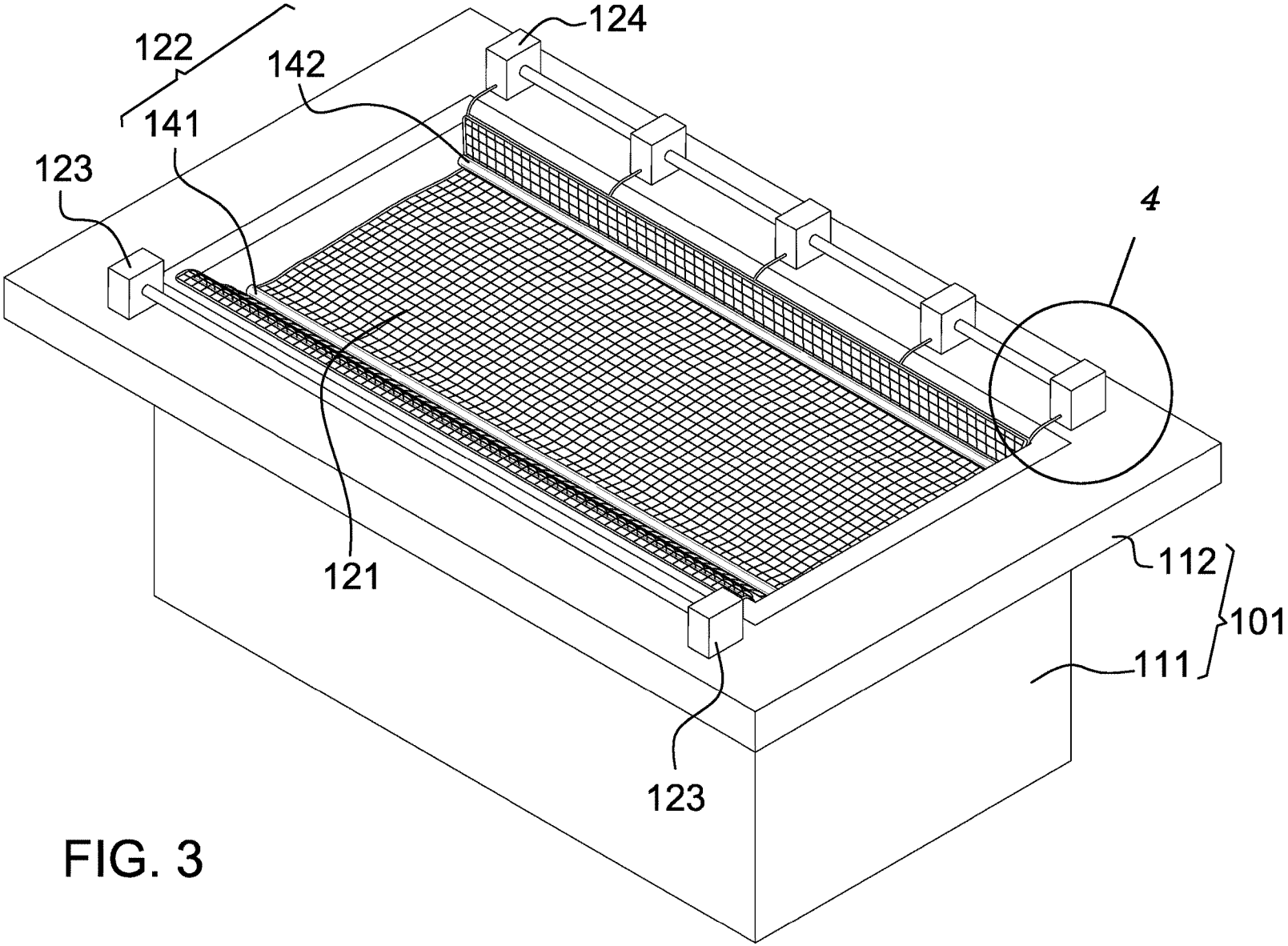
FIG. 3 is a reverse perspective view of an embodiment of the disclosure.
Figure 4:
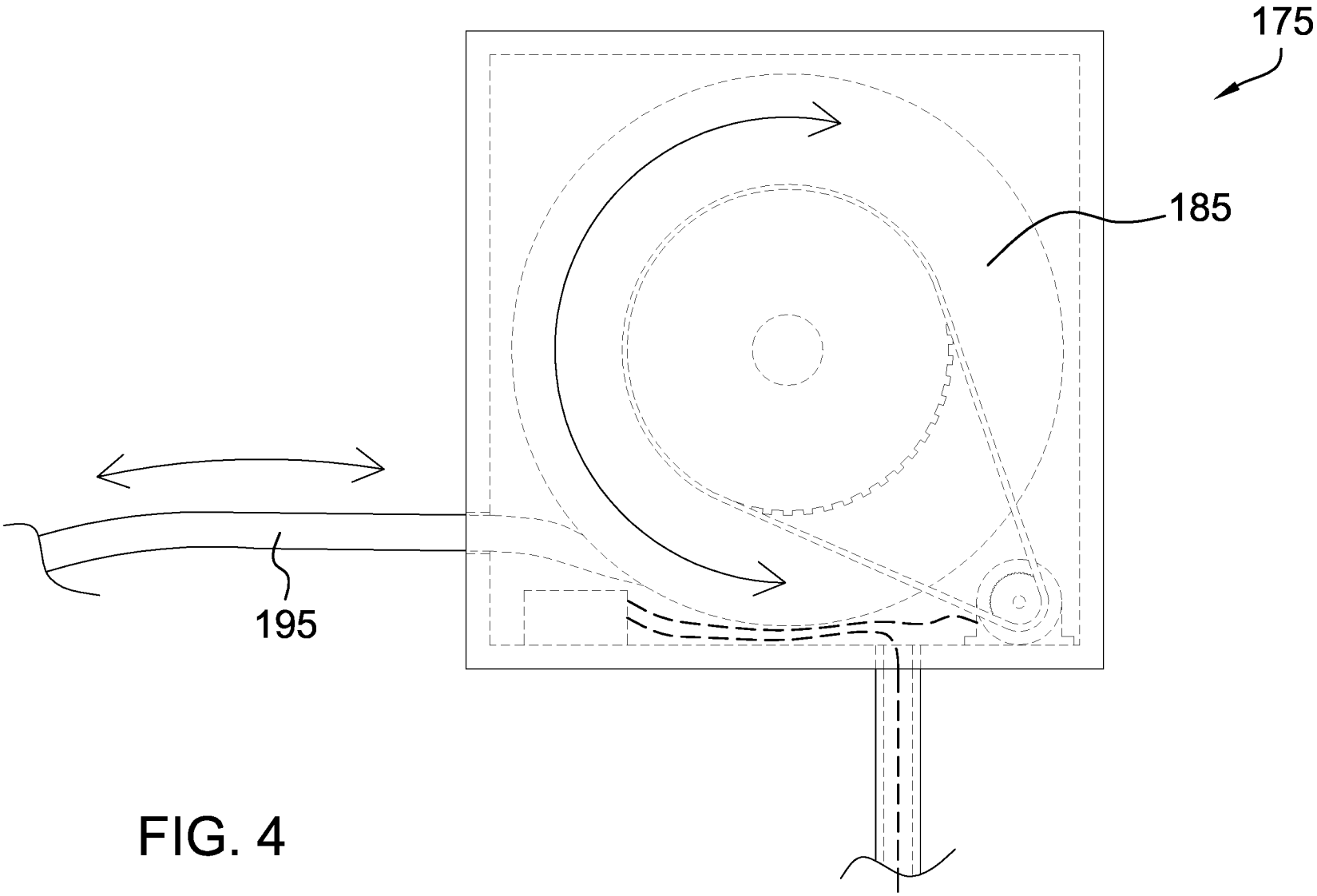
FIG. 4 is a reverse perspective view of an embodiment of the disclosure.
Figure 5:
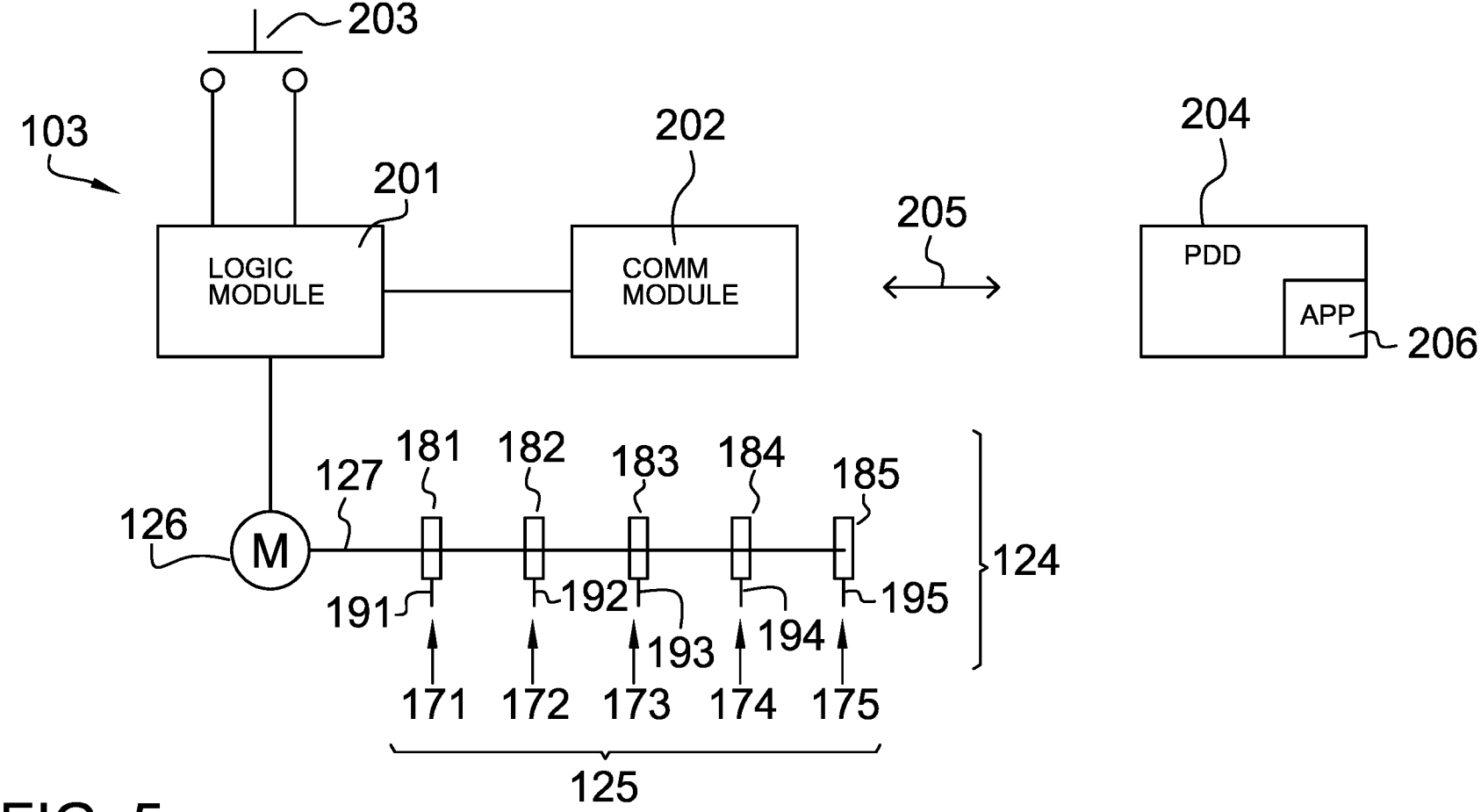
FIG. 5 is a schematic view of an embodiment of the disclosure.

Detailed reference will now be made to one or more potential embodiments of the disclosure, which are illustrated in FIGS. 1 through 5.

The pool safety net system 100 (hereinafter invention) comprises a pool 111 structure 101 and an adjustable flooring 102. The adjustable flooring 102 installs in the pool 111 structure 101. The adjustable flooring 102 forms a horizontal surface that supports objects that sink into the pool 111 structure 101. The adjustable flooring 102 is adjustable such that the depth that an object sinks into the pool 111 structure 101 is adjustable. The invention 100 further comprises a control circuit 103. The control circuit 103 controls the adjustment of the adjustable flooring 102. The control circuit 103 is remotely controlled.

The pool 111 structure 101 is a man made structure. The pool 111 structure 101 forms an artificial body of water used for recreation. The pool 111 structure 101 comprises a pool 111 and an apron 112. The pool 111 is a man made structure. The pool 111 is a containment structure. The pool 111 forms a pan shaped structure used to contain water. The pool 111 is defined elsewhere in this disclosure. The apron 112 is a horizontally oriented surface that forms a rim around the perimeter of the open face of the pan structure of the pool 111. The adjustable flooring 102 permanently anchors to the apron 112.

The adjustable flooring 102 is a mechanical structure formed within the pool 111. The adjustable flooring 102 form a horizontal supporting surface within the pool 111. The adjustable flooring 102 forms an adjustable supporting surface. By adjustable is meant that the depth of the adjustable flooring 102 within the pool 111 is adjustable. By depth is meant the span of the vertical distance from the surface of the water contained in the pool 111 to the supporting surface formed by the adjustable flooring 102. The adjustable flooring 102 comprises a mesh sheeting 121, a plurality of weights 122, a stationary mesh mount 123, and a drive structure 124.

The mesh sheeting 121 is a sheeting structure. The mesh sheeting 121 is a load bearing structure. The mesh sheeting 121 is a flexible structure. The mesh sheeting 121 is formed as a mesh. The mesh sheeting 121 forms the horizontally oriented supporting surface of the adjustable flooring 102. The mesh sheeting 121 comprises a first edge 131, a second edge 132, a third edge 133, and a fourth edge 134.

The first edge 131 is the edge of the mesh sheeting 121 with the shortest span of length. The second edge 132 is the edge of the mesh sheeting 121 with the greatest span of length. The third edge 133 is the edge of the mesh sheeting 121 that is distal from the first edge 131. The span of the length of the third edge 133 roughly equals the span of the length of the first edge 131. The fourth edge 134 is the edge of the mesh sheeting 121 that is distal from the second edge 132. The span of the length of the fourth edge 134 roughly equals the span of the length of the second edge 132.

Each of the plurality of weights 122 is a prism-shaped structure. Each of the plurality of weights 122 has a cylindrical shape. Each of the plurality of weights 122 attaches to the same face of the mesh sheeting 121. Each of the plurality of weights 122 attaches to the mesh sheeting 121 such that each of the plurality of weights 122 rolls along the face of the mesh sheeting 121. The force of gravity pulls each of the plurality of weights 122 in a vertical direction. By securing each of the plurality of weights 122 to the mesh sheeting 121, each of the plurality of weights 122 pulls the face of the mesh sheeting 121 against a vertical surface of the pool 111. The plurality of weights 122 comprises a first weight 141 and a second weight 142.

The first weight 141 is the cylindrical structure selected from the plurality of weights 122 that attaches to the mesh sheeting 121 at a position between the first edge 131 and the second weight 142. The first weight 141 attaches to the mesh sheeting 121 such that the center axis of the prism structure of the first weight 141 is parallel to the first edge 131.

The second weight 142 is the cylindrical structure selected from the plurality of weights 122 that attaches to the mesh sheeting 121 at a position between the third edge 133 and the first weight 141. The second weight 142 attaches to the mesh sheeting 121 such that the center axis of the prism structure of the second weight 142 is parallel to the third edge 133.

The stationary mesh mount 123 is a mechanical structure that anchors the mesh sheeting 121 to the apron 112 to the pool 111 structure 101. The first edge 131 of the mesh sheeting 121 permanently attaches to the stationary mesh mount 123. The stationary mesh mount 123 comprises a first bollard 151, a second bollard 152, a stationary beam 153, and a plurality of stationary stays 154.

The first bollard 151 is a stanchion used to anchor the stationary beam 153 to the apron 112. The second bollard 152 is a stanchion used to anchor the stationary beam 153 to the apron 112. The first bollard 151 and the second bollard 152 elevate the stationary beam 153 above the apron 112.

The stationary beam 153 is a prism structure. The congruent end of the stationary beam 153 attach to the first bollard 151 and the second bollard 152 such that the center axis of the prism structure of the stationary beam 153 is vertically oriented. The stationary beam 153 forms an inert structure to which the fixed end of each of the plurality of stationary stays 154 permanently attaches.

Each stationary stay selected from the plurality of stationary stays 154 is a cable. Each stationary stay selected from the plurality of stationary stays 154 has an identical length. Each stationary stay selected from the plurality of stationary stays 154 permanently attaches the first edge 131 of the mesh sheeting 121 to the stationary beam 153. Each stationary stay selected from the plurality of stationary stays 154 suspends the first edge 131 from the stationary beam 153.

The plurality of stationary stays 154 comprises a first stationary stay 161, a second stationary stay 162, a third stationary stay 163, a fourth stationary stay 164, and a fifth stationary stay 165.

The first stationary stay 161 is the stay selected from the plurality of stationary stays 154 that attaches to the stationary beam 153 at a position proximal to the first bollard 151. The second stationary stay 162 is the stay selected from the plurality of stationary stays 154 that attaches to the stationary beam 153 at a position between the first bollard 151 and the third stationary stay 163. The third stationary stay 163 is the stay selected from the plurality of stationary stays 154 that attaches to the stationary beam 153 at a position between the second stationary stay 162 and the fourth stationary stay 164. The fourth stationary stay 164 is the stay selected from the plurality of stationary stays 154 that attaches to the stationary beam 153 at a position between the third stationary stay 163 and the fifth stationary stay 165. The fifth stationary stay 165 is the stay selected from the plurality of stationary stays 154 that attaches to the stationary beam 153 at a position proximal to the second bollard 152.

The drive structure 124 is a mechanical structure. The drive structure 124 transfers electric energy provided by the control circuit 103 into rotational mechanical energy used to raise and lower the depth of the mesh sheeting 121. The drive structure 124 anchors the mesh sheeting 121 to the apron 112 of the pool 111 structure 101. The third edge 133 of the mesh sheeting 121 permanently attaches to the drive structure 124. The drive structure 124 adjusts the depth of the horizontal supporting surface formed by the mesh sheeting 121 by adjusting the depth of the third edge 133 in the pool 111. Specifically, the drive structure 124 increases and decreases the depth of the third edge 133. The drive structure 124 comprises a plurality of winches 125, a drive motor 126, and a drive shaft 127. The drive shaft 127 attaches the drive motor 126 to each of the plurality of winches 125 such that the rotation of the drive motor 126 rotates the plurality of winches 125.

Each of the plurality of winches 125 is a winch. The winch is defined elsewhere in this disclosure. Each winch selected from the plurality of winches 125 is adjustable. Each winch selected from the plurality of winches 125 comprises a winch spool and a winch stay. The winch stay of each selected winch is a cable. The free end of the winch stay of each selected winch attaches to the third edge 133 of the mesh sheeting 121. Each fixed end of the winch stay of each winch selected from the plurality of winches 125 attaches to the winch spool associated with the selected winch. The spool is defined elsewhere in this disclosure. The winch spool forms a storage structure that contains the winch stay.

Each winch selected from the plurality of winches 125 pays out and retracts the winch stay associated with the selected winch from the winch spool associated with the selected winch. The adjustable flooring 102 is adjusted by adjusting the number of linear feet of winch stay that each winch selected from the plurality of winches 125 has paid out.

The plurality of winches 125 comprises a first winch 171, a second winch 172, a third winch 173, a fourth winch 174, and a fifth winch 175.

The first winch 171 is the winch selected from the plurality of winches 125 that attaches to the drive shaft 127 at a position proximal to the drive motor 126. The first winch 171 comprises a first winch 171 spool 181 and a first winch 171 stay 191. The first winch 171 spool 181 is the spool associated with the first winch 171. The first winch 171 spool 181 pays out, retracts, and stores the first winch 171 stay 191. The first winch 171 stay 191 is the cable that secures the first winch 171 to the third edge 133 of the mesh sheeting 121.

The second winch 172 is the winch selected from the plurality of winches 125 that attaches to the drive shaft 127 at a position between the first winch 171 and the third winch 173. The second winch 172 comprises a second winch 172 spool 182 and a second winch 172 stay 192. The second winch 172 spool 182 is the spool associated with the second winch 172. The second winch 172 spool 182 pays out, retracts, and stores the second winch 172 stay 192. The second winch 172 stay 192 is the cable that secures the second winch 172 to the third edge 133 of the mesh sheeting 121.

The third winch 173 is the winch selected from the plurality of winches 125 that attaches to the drive shaft 127 at a position between the second winch 172 and the fourth winch 174. The third winch 173 comprises a third winch 173 spool 183 and a third winch 173 stay 193. The third winch 173 spool 183 is the spool associated with the third winch 173. The third winch 173 spool 183 pays out, retracts, and stores the third winch 173 stay 193. The third winch 173 stay 193 is the cable that secures the third winch 173 to the third edge 133 of the mesh sheeting 121.

The fourth winch 174 is the winch selected from the plurality of winches 125 that attaches to the drive shaft 127 at a position between the third winch 173 and the fifth winch 175. The fourth winch 174 comprises a fourth winch 174 spool 184 and a fourth winch 174 stay 194. The fourth winch 174 spool 184 is the spool associated with the fourth winch 174. The fourth winch 174 spool 184 pays out, retracts, and stores the fourth winch 174 stay 194. The fourth winch 174 stay 194 is the cable that secures the fourth winch 174 to the third edge 133 of the mesh sheeting 121.

The fifth winch 175 is the winch selected from the plurality of winches 125 that attaches to the drive shaft 127 at a position distal from the drive motor 126. The fifth winch 175 comprises a fifth winch 175 spool 185 and a fifth winch 175 stay 195. The fifth winch 175 spool 185 is the spool associated with the fifth winch 175. The fifth winch 175 spool 185 pays out, retracts, and stores the fifth winch 175 stay 195. The fifth winch 175 stay 195 is the cable that secures the fifth winch 175 to the third edge 133 of the mesh sheeting 121.

The drive motor 126 is an electric motor. The drive motor 126 converts electric energy into the rotational energy necessary to operate the plurality of winches 125. The control circuit 103 controls the operation of the drive motor 126. By controlling the operation is meant that the control circuit 103: a) determines the speed of rotation of the drive motor 126; and, b) controls the direction of rotation of the drive motor 126. The drive motor 126 attaches to the drive shaft 127 such that the rotation of the drive motor 126 rotates the drive shaft 127.

The drive shaft 127 is a prism-shaped structure. The drive shaft 127 forms a mechanical linkage between the drive motor 126 and each winch selected from the plurality of winches 125. The drive shaft 127 attaches to the winch spool associated with each winch selected from the plurality of winches 125. The rotation of the drive shaft 127 rotates the winch spool of each winch selected from the plurality of winches 125 such that the rotation of the winch spool pays out and retracts the winch stay from the winch spool.

The control circuit 103 is an electric circuit. The control circuit 103 converts electric energy into the rotational energy necessary to operate the adjustable flooring 102. The control circuit 103 controls the operation of the adjustable flooring 102. The control circuit 103 repositions the depth of the adjustable flooring 102. The control circuit 103 is a remotely controlled device. By remotely controlled is meant that control circuit 103 receives operating instructions regarding the depth of the adjustable flooring 102 over a wireless communication link 205. The control circuit 103 further comprises an emergency override 203. The emergency override 203 is a safety device that is hardwired into the control circuit 103. The initiation of the operation of the emergency override 203 redirects the operation of the control circuit 103 such that the control circuit 103 immediately raises the depth of the adjustable flooring 102 to its minimum depth.

The control circuit 103 comprises a logic module 201 and a communication module 202. The logic module 201 and the communication module 202 are electrically interconnected. The logic module 201 further comprises the emergency override 203. The communication module 202 further comprises a personal data device 204 and a wireless communication link 205. The communication module forms the wireless communication link 205 with the personal data device 204. The personal data device 204 further comprises an application 206.

The logic module 201 is a readily and commercially available programmable electronic device that is used to manage, regulate, and operate the control circuit 103. Depending on the specific design and the selected components, the logic module 201 can be a separate component within the control circuit 103 or the functions of the logic module 201 can be incorporated into another component within the control circuit 103. The communication module 202 is a wireless electronic communication device that allows the logic module 201 to wirelessly communicate with a personal data device 204. Specifically the communication module 202 establishes a wireless communication link 205 between the control circuit 103 and the personal data device 204. The communication module 202 exchanges operating instructions and information between the personal data device 204 and the logic module 201 over the wireless communication link 205. In the first potential embodiment of the disclosure the communication module 202 supports a communication protocol selected from the group consisting of a WiFi™ protocol or a Bluetooth™ protocol.

The personal data device 204 is a programmable electrical device that provides data management and communication services through one or more functions referred to as an application 206. The application 206 is a set of logical operating instructions that are performed by the personal data device 204. The addition of an application 206 will provide increased functionality for the personal data device 204. This disclosure assumes that an application 206 exists for the purpose of interacting with the invention 100. Methods to design and implement an application 206 on a personal data device 204 are well known and documented in the electrical arts.

The logic module 201 controls the operation of the adjustable flooring 102 by controlling the flow of electric energy into the drive motor 126. The logic module 201 controls both the speed of rotation and the direction of rotation of the drive motor 126. The emergency override 203 is a momentary switch. The emergency override 203 is hardwired to the logic module 201. The logic module 201 monitors the emergency override 203. When the logic module 201 detects that the emergency override 203 has been actuated, the logic module 201 raises the adjustable flooring 102 to the minimum available depth.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Bluetooth™: As used in this disclosure, Bluetooth™ is a standardized communication protocol that is used to wirelessly interconnect electronic devices.

Beam: As used in this disclosure, a beam is a horizontally oriented shaft that: 1) is suspended above a supporting surface; and, 2) bears a load.

Bollard: As used in this disclosure, a bollard is a heavy vertical stanchion used as an anchor point to anchor an object to a horizontal surface. Bollards are often called Samson posts.

Cable: As used in this disclosure, a cable is a cord formed from braided metal wires.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Communication Link: As used in this disclosure, a communication link refers to the structured exchange of data between two objects.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar. Use Prism, pyramid, geometrically similar, truncated, align Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, yarn, and rope are synonyms for cord.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Fixed End: As used in this disclosure, a fixed end refers to the end of a cord or webbing that attaches to an object.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Free End: As used in this disclosure, a free end refers to the end of a cord or webbing that is not secured to an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Hardwired: As used in this disclosure, the term hardwired refers to a physical electrical connection between two electrical circuits or circuit elements. Such a hardwired connection is considered more reliable than a wireless connection.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inert: As used in this disclosure, inert is an adjective that is applied to an object, system, or chemical reaction. Inert means that the object, system, or chemical reaction is incapable of internal motion, internal activity or is otherwise unreactive.

Inferior: As used in this disclosure, the term inferior refers to a directional reference that is parallel to and in the same direction as the force of gravity when an object is positioned or used normally.

Interlock: As used in this disclosure, an interlock is a second mechanism that enables and disables the operation of a first mechanism. Generally, an interlock is used as a safety device.

Limit Switch: As used in this disclosure, a limit switch is an electrical switch that is actuated by a moving object that is at, or past, the position of the switch. The limit switch is used to detect the position of the moving object.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Logic Module: As used in this disclosure, a logic module is a readily and commercially available electrical device that accepts digital and analog inputs, processes the digital and analog inputs according to previously specified logical processes and provides the results of these previously specified logical processes as digital or analog outputs. The disclosure allows, but does not assume, that the logic module is programmable.

Maintained Switch: A used in this disclosure, a maintained switch is a switch that maintains the position that was set in the most recent switch actuation. A maintained switch works in an opposite manner to a momentary switch.

Mesh: As used in this disclosure, the term mesh refers to an openwork fabric made from threads, yarns, cords, wires, or lines that are woven, knotted, or otherwise twisted or intertwined at regular intervals. Synonyms for mesh include net. A mesh structure formed from metal bars or wires is often referred to as a grate.

Motor: As used in this disclosure, a motor refers to the method of transferring energy from an external power source into rotational mechanical energy.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

PDD: As used in this disclosure, PDD is an acronym for personal data device.

Perimeter: As used in this disclosure, a perimeter is one or more curved or straight lines that bounds an enclosed area on a plane or surface. The perimeter of a circle is commonly referred to as a circumference.

Personal Data Device: As used in this disclosure, a personal data device is a handheld logical device that is used for managing personal information and communication. Examples of personal data device include, but are not limited to, cellular phones, tablets, and smartphones. See logical device Platform: As used in this disclosure, a platform is a raised horizontal surface that forms a load path to support objects placed on the superior surface of the platform.

Pool: As used in this disclosure, a pool is a self-contained body of water. By self-contained is meant that that fluidic connections between the pool and the other bodies of water do not result in a significant change or difference in the water volume contained in the pool over a 24 hour period. A pool can be naturally formed or a manmade structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Remote Control: As used in this disclosure, remote control means the establishment of control of a device from a distance. Remote control is generally accomplished through the use of an electrical device that generates electrically based control signals that are transmitted via radio frequencies or other means to the device.

Rim: As used in this disclosure, a rim is an outer edge or border that follows along the perimeter of an object.

Roughly: As used in this disclosure, roughly refers to a comparison between two objects. Roughly means that the difference between one or more parameters of the two compared objects are not significantly different.

Sheeting: As used in this disclosure, a sheeting is a material, such as a paper, textile, a plastic, or a metal foil, in the form of a thin flexible layer or layers. The sheeting forms a disk structure. The two surfaces of the sheeting with the greatest surface area are called the faces of the sheeting.

Spool: As used in this disclosure, a spool is a cylindrical device upon which a flexible material, including but not limited to a sheeting, yarn, a cord, or a tape, can be wound. Depending on context, a spool may also contain the flexible material stored upon the spool.

Stanchion: As used in this disclosure, a stanchion refers to a vertically oriented prism-shaped pole, post, or support.

Stay: As used in this disclosure, a stay is a rope, line, cord, or strap or tape that is used to steady, guide, hold, or secure an object. A common synonym for stay is guy line. A stay that has a fastening device on each end is often called a lanyard.

Superior: As used in this disclosure, the term superior refers to a directional reference that is parallel to and in the opposite direction of the force of gravity when an object is positioned or used normally.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

WiFi™: As used in this disclosure, WiFi™ refers to the physical implementation of a collection of wireless electronic communication standards commonly referred to as IEEE 802.11x.

Winch: As used in this disclosure, a winch is a device that comprises a cord and a rotating spool. The cord is wound on the spool. The winch is used to move or lift an object by: 1) partially unwinding the cord from the rotating spool; 2) attaching the free end of the cord to the object to be moved or lifted; and, 3) winding the cord back on to the rotating spool in order to move or lift the object.

Wireless: As used in this disclosure, wireless is an adjective that is used to describe a communication channel between two devices that does not require the use of physical cabling.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A pool safety net system comprising a pool structure and an adjustable flooring;

wherein the adjustable flooring installs in the pool structure;

wherein the adjustable flooring forms a horizontal surface that supports objects that sink into the pool structure;

wherein the adjustable flooring is adjustable such that the depth that an object sinks into the pool structure is adjustable;

wherein the pool safety net system further comprises a control circuit;

wherein the control circuit controls the adjustment of the adjustable flooring;

wherein the control circuit is remotely controlled;

wherein the adjustable flooring comprises a mesh sheeting, a plurality of weights, a stationary mesh mount, and a drive structure;

wherein the plurality of weights attach to the mesh sheeting;

wherein the stationary mesh mount and the drive structure attach the mesh sheeting to the apron of the pool structure;

wherein each of the plurality of weights has a cylindrical shape;

wherein each of the plurality of weights attaches to the same face of the mesh sheeting;

wherein each of the plurality of weights attaches to the mesh sheeting such that each of the plurality of weights rolls along the face of the mesh sheeting;

wherein the force of gravity pulls each of the plurality of weights in a vertical direction;

wherein by securing each of the plurality of weights to the mesh sheeting, each of the plurality of weights pulls the face of the mesh sheeting against a vertical surface of the pool;

wherein the pool structure is a man made structure;

wherein the pool structure forms an artificial body of water used for recreation;

wherein the pool structure comprises a pool and an apron;

wherein the pool is a containment structure;

wherein the pool forms a pan shaped structure used to contain water;

wherein the apron is a horizontally oriented surface that forms a rim around the perimeter of the open face of the pan structure of the pool;

wherein the adjustable flooring permanently anchors to the apron;

wherein the adjustable flooring is a mechanical structure formed within the pool;

wherein the adjustable flooring form a horizontal supporting surface within the pool;

wherein the adjustable flooring forms an adjustable supporting surface;

wherein by depth is meant the span of the vertical distance from the surface of the water contained in the pool to the supporting surface formed by the adjustable flooring;

wherein the control circuit is an electric circuit;

wherein the control circuit converts electric energy into the rotational energy necessary to operate the adjustable flooring;

wherein the control circuit controls the operation of the adjustable flooring;

wherein the control circuit repositions the depth of the adjustable flooring;

wherein the control circuit is a remotely controlled device;

wherein by remotely controlled is meant that control circuit receives operating instructions regarding the depth of the adjustable flooring over a wireless communication link;

wherein the control circuit further comprises an emergency override;

wherein the emergency override is a safety device that is hardwired into the control circuit;

wherein the initiation of the operation of the emergency override redirects the operation of the control circuit such that the control circuit immediately raises the depth of the adjustable flooring to its minimum depth.

2. The pool safety net system according to claim 1 wherein the control circuit comprises a logic module and a communication module;

wherein the logic module and the communication module are electrically interconnected;

wherein the logic module further comprises the emergency override;

wherein the communication module further comprises a personal data device and a wireless communication link;

wherein the communication module forms the wireless communication link with the personal data device;

wherein the personal data device further comprises an application.

3. The pool safety net system according to claim 2 wherein the mesh sheeting is a sheeting structure;

wherein the mesh sheeting is a load bearing structure;

wherein the mesh sheeting is a flexible structure;

wherein the mesh sheeting is formed as a mesh;

wherein the mesh sheeting forms the horizontally oriented supporting surface of the adjustable flooring;

wherein the mesh sheeting comprises a first edge, a second edge, a third edge, and a fourth edge;

wherein the first edge is the edge of the mesh sheeting with the shortest span of length;

wherein the second edge is the edge of the mesh sheeting with the greatest span of length;

wherein the third edge is the edge of the mesh sheeting that is distal from the first edge;

wherein the span of the length of the third edge roughly equals the span of the length of the first edge;

wherein the fourth edge is the edge of the mesh sheeting that is distal from the second edge;

wherein the span of the length of the fourth edge roughly equals the span of the length of the second edge.

4. The pool safety net system according to claim 3 wherein the plurality of weights comprises a first weight and a second weight;

wherein the first weight is the cylindrical structure selected from the plurality of weights that attaches to the mesh sheeting at a position between the first edge and the second weight;

wherein the first weight attaches to the mesh sheeting such that the center axis of the first weight is parallel to the first edge;

wherein the second weight is the cylindrical structure selected from the plurality of weights that attaches to the mesh sheeting at a position between the third edge and the first weight;

wherein the second weight attaches to the mesh sheeting such that the center axis of the second weight is parallel to the third edge.

5. The pool safety net system according to claim 4 wherein the stationary mesh mount is a mechanical structure that anchors the mesh sheeting to the apron to the pool structure;

wherein the first edge of the mesh sheeting permanently attaches to the stationary mesh mount.

6. The pool safety net system according to claim 5 wherein the stationary mesh mount comprises a first bollard, a second bollard, a stationary beam, and a plurality of stationary stays;

wherein the first bollard is a stanchion used to anchor the stationary beam to the apron;

wherein the second bollard is a stanchion used to anchor the stationary beam to the apron;

wherein the first bollard and the second bollard elevate the stationary beam above the apron;

wherein the congruent end of the stationary beam attach to the first bollard and the second bollard such that the center axis of the stationary beam is vertically oriented;

wherein each stationary stay selected from the plurality of stationary stays suspends the first edge from the stationary beam.

7. The pool safety net system according to claim 6 wherein the stationary beam forms an inert structure to which the fixed end of each of the plurality of stationary stays permanently attaches;

wherein each stationary stay selected from the plurality of stationary stays is a cable;

wherein each stationary stay selected from the plurality of stationary stays has an identical length;

wherein each stationary stay selected from the plurality of stationary stays permanently attaches the first edge of the mesh sheeting to the stationary beam.

8. The pool safety net system according to claim 7 wherein the drive structure is a mechanical structure;

wherein the drive structure transfers electric energy provided by the control circuit into rotational mechanical energy used to raise and lower the depth of the mesh sheeting;

wherein the drive structure anchors the mesh sheeting to the apron of the pool structure;

wherein the third edge of the mesh sheeting permanently attaches to the drive structure;

wherein the drive structure adjusts the depth of the horizontal supporting surface formed by the mesh sheeting by adjusting the depth of the third edge in the pool;

wherein the drive structure increases and decreases the depth of the third edge.

9. The pool safety net system according to claim 8 wherein the drive structure comprises a plurality of winches, a drive motor, and a drive shaft;

wherein the drive shaft attaches the drive motor to each of the plurality of winches such that the rotation of the drive motor rotates the plurality of winches;

wherein each of the plurality of winches is a winch;

wherein each winch selected from the plurality of winches is adjustable;

wherein each winch selected from the plurality of winches comprises a winch spool and a winch stay;

wherein the winch stay of each selected winch is a cable;

wherein the free end of the winch stay of each selected winch attaches to the third edge of the mesh sheeting;

wherein each fixed end of the winch stay of each winch selected from the plurality of winches attaches to the winch spool associated with the selected winch;

wherein the winch spool forms a storage structure that contains the winch stay;

wherein each winch selected from the plurality of winches pays out and retracts the winch stay associated with the selected winch from the winch spool associated with the selected winch;

wherein the adjustable flooring is adjusted by adjusting the number of linear feet of winch stay that each winch selected from the plurality of winches has paid out.

10. The pool safety net system according to claim 9 wherein the drive motor is an electric motor;

wherein the drive motor converts electric energy into the rotational energy necessary to operate the plurality of winches;

wherein the control circuit controls the operation of the drive motor;

wherein by controlling the operation is meant that the control circuit: a) determines the speed of rotation of the drive motor; and, b) controls the direction of rotation of the drive motor;

wherein the drive motor attaches to the drive shaft such that the rotation of the drive motor rotates the drive shaft.

11. The pool safety net system according to claim 10 wherein the drive shaft forms a mechanical linkage between the drive motor and each winch selected from the plurality of winches;

wherein the drive shaft attaches to the winch spool associated with each winch selected from the plurality of winches;

wherein the rotation of the drive shaft rotates the winch spool of each winch selected from the plurality of winches such that the rotation of the winch spool pays out and retracts the winch stay from the winch spool.

12. The pool safety net system according to claim 11 wherein the logic module is a programmable electronic device;

wherein the communication module is a wireless electronic communication device that allows the logic module to wirelessly communicate with a personal data device;

wherein the personal data device is a programmable electrical device;

wherein the application is a set of logical operating instructions that are performed by the personal data device;

wherein the communication module establishes a wireless communication link between the control circuit and the personal data device;

wherein the communication module exchanges operating instructions and information between the personal data device and the logic module over the wireless communication link.

13. The pool safety net system according to claim 12 wherein the logic module controls the operation of the adjustable flooring by controlling the flow of electric energy into the drive motor;

wherein the logic module controls both the speed of rotation and the direction of rotation of the drive motor;

wherein the emergency override is a momentary switch;

wherein the emergency override is hardwired to the logic module;

wherein the logic module monitors the emergency override;

wherein when the logic module detects that the emergency override has been actuated, the logic module raises the adjustable flooring to the minimum available depth.

14. The pool safety net system according to claim 13 wherein the plurality of winches comprises a first winch, a second winch, a third winch, a fourth winch, and a fifth winch;

wherein the first winch is the winch selected from the plurality of winches that attaches to the drive shaft at a position proximal to the drive motor;

wherein the first winch comprises a first winch spool and a first winch stay;

wherein the first winch spool is the spool associated with the first winch;

wherein the first winch spool pays out, retracts, and stores the first winch stay;

wherein the first winch stay is the cable that secures the first winch to the third edge of the mesh sheeting;

wherein the second winch is the winch selected from the plurality of winches that attaches to the drive shaft at a position between the first winch and the third winch;

wherein the second winch comprises a second winch spool and a second winch stay;

wherein the second winch spool is the spool associated with the second winch;

wherein the second winch spool pays out, retracts, and stores the second winch stay;

wherein the second winch stay is the cable that secures the second winch to the third edge of the mesh sheeting;

wherein the third winch is the winch selected from the plurality of winches that attaches to the drive shaft at a position between the second winch and the fourth winch;

wherein the third winch comprises a third winch spool and a third winch stay;

wherein the third winch spool is the spool associated with the third winch;

wherein the third winch spool pays out, retracts, and stores the third winch stay;

wherein the third winch stay is the cable that secures the third winch to the third edge of the mesh sheeting;

wherein the fourth winch is the winch selected from the plurality of winches that attaches to the drive shaft at a position between the third winch and the fifth winch;

wherein the fourth winch comprises a fourth winch spool and a fourth winch stay;

wherein the fourth winch spool is the spool associated with the fourth winch;

wherein the fourth winch spool pays out, retracts, and stores the fourth winch stay;

wherein the fourth winch stay is the cable that secures the fourth winch to the third edge of the mesh sheeting;

wherein the fifth winch is the winch selected from the plurality of winches that attaches to the drive shaft at a position distal from the drive motor;

wherein the fifth winch comprises a fifth winch spool and a fifth winch stay;

wherein the fifth winch spool is the spool associated with the fifth winch;

wherein the fifth winch spool pays out, retracts, and stores the fifth winch stay;

wherein the fifth winch stay is the cable that secures the fifth winch to the third edge of the mesh sheeting.

15. The pool safety net system according to claim 14 wherein the plurality of stationary stays comprises a first stationary stay, a second stationary stay, a third stationary stay, a fourth stationary stay, and a fifth stationary stay;

wherein the first stationary stay is the stay selected from the plurality of stationary stays that attaches to the stationary beam at a position proximal to the first bollard;

wherein the second stationary stay is the stay selected from the plurality of stationary stays that attaches to the stationary beam at a position between the first bollard and the third stationary stay;

wherein the third stationary stay is the stay selected from the plurality of stationary stays that attaches to the stationary beam at a position between the second stationary stay and the fourth stationary stay;

wherein the fourth stationary stay is the stay selected from the plurality of stationary stays that attaches to the stationary beam at a position between the third stationary stay and the fifth stationary stay;

wherein the fifth stationary stay is the stay selected from the plurality of stationary stays that attaches to the stationary beam at a position proximal to the second bollard.

* * * * *